US005598685A

United States Patent [19]

Graham et al.

[11] Patent Number: 5,598,685

[45] Date of Patent: Feb. 4, 1997

[54] APPARATUS AND PROCESS FOR PACKAGING FRAGILE ARTICLES

[75] Inventors: Thomas Graham, Orlando, Fla.; William J. Courteau, Hugo, Minn.

[73] Assignee: Stone Container Corporation, Chicago, Ill.

[21] Appl. No.: 403,646

[22] Filed: Mar. 14, 1995

[51] Int. Cl.[6] ..... B65B 11/00

[52] U.S. Cl. ..... 53/464; 53/462; 53/221

[58] Field of Search ..... 53/207, 221, 222, 53/228, 230, 461, 462, 464, 466

[56] References Cited

U.S. PATENT DOCUMENTS

| | | | |
|---|---|---|---|
| 3,354,600 | 11/1967 | Hoffman | 53/462 |
| 3,866,391 | 2/1975 | Puskral | 53/207 |
| 4,642,967 | 2/1987 | Culpepper | 53/209 |
| 5,148,654 | 9/1992 | Kisters | 53/462 |

OTHER PUBLICATIONS

Stone Container Corp. brochure, "RAP–A–MAT 350", as early as Feb. 1994.

Stone Container Corp. brochure, "RAP–A–MAT 300", as early as Feb. 1994.

Stone Container Corp. brochure, "1588 Automatic Case Packer", as early as Feb. 1994.

*Primary Examiner*—James F. Coan
*Assistant Examiner*—Gene L. Kim
*Attorney, Agent, or Firm*—Dick and Harris

[57] ABSTRACT

A process for the packaging of fragile articles, such as processed foods articles. The fragile articles are receiving from a source and positioned in a staging area, prior to being placed, in a shock-free manner, upon an unerected container blank. The protective container is erected around the fragile articles, substantially without any contact or physical shock to the fragile articles, so as to preclude damage to the articles. The invention further includes an apparatus for accomplishing the process of packaging the fragile articles.

10 Claims, 5 Drawing Sheets

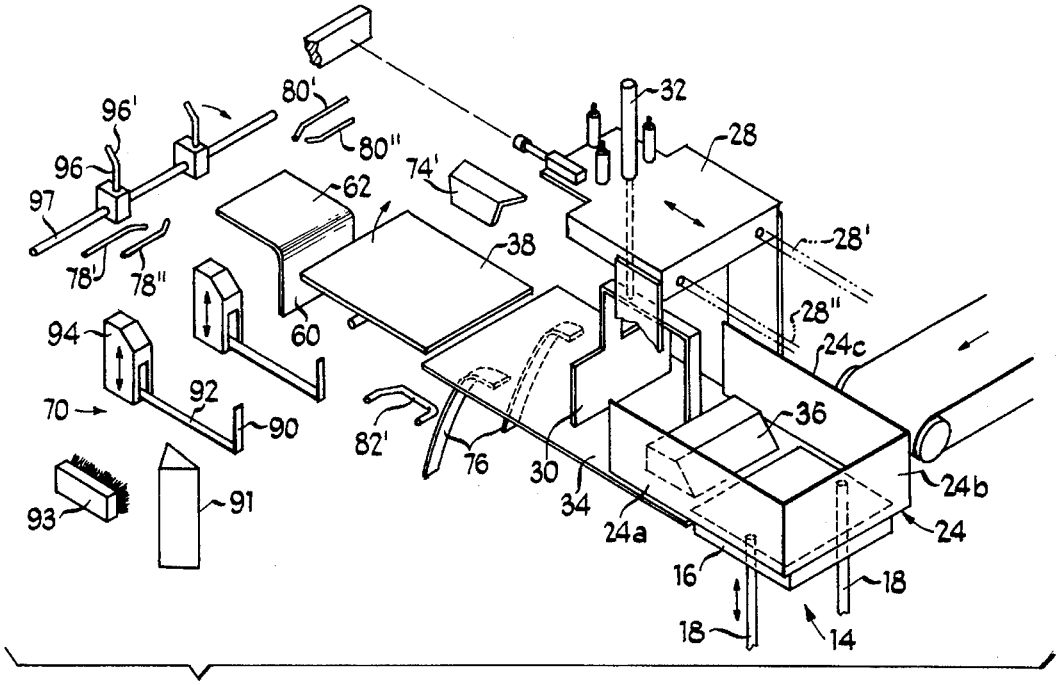
Fig 4
Fig 5
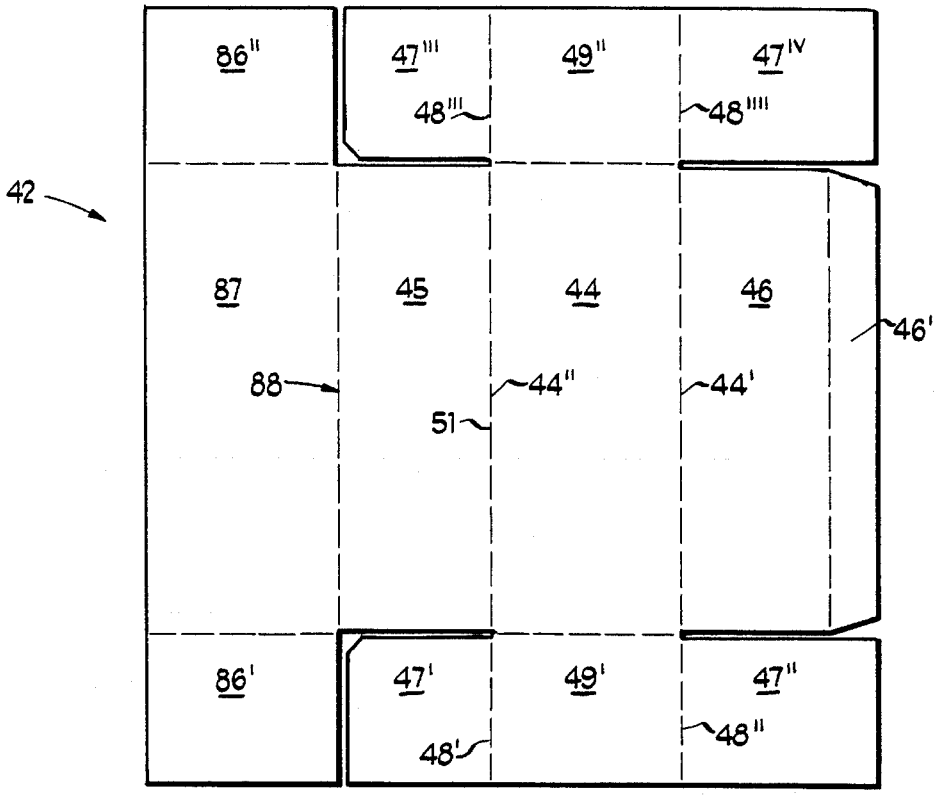

APPARATUS AND PROCESS FOR PACKAGING FRAGILE ARTICLES

BACKGROUND OF THE INVENTION

The present invention relates generally to apparatus and process for packaging articles, in particular fragile articles such as food items.

A major problem in the handling of fragile articles, such as sharp and/or fragile food articles, is the actual initial packaging of the fragile article, once the food article has been processed.

For example, it has become popular to package certain meat articles, which are generally known to be particularly perishable and prone to spoilage and contamination, in a vacuum-packed plastic bag, and then frozen, for long-term storage. The vacuum-packed plastic bag closely follows the contours of the food item, so that no air is trapped. This helps prevent the occurrence of oxidation of the meat product, prior to complete freezing, helps preclude freezer burn, and generally improves the overall condition of the food product.

Unfortunately, some meat articles, particularly those still having the bone in place after processing, are problematic to package in such vacuum-packed plastic bags. This is because the often rather sharp-edged bones in the meat product have substantial potential for puncturing or cutting through the plastic bag, if the meat product is handled roughly. In fact, handling procedures which would otherwise be acceptable for other packaged meat articles, such as ground beef, steaks, etc. produce unacceptably high numbers of failed packages, for meat articles such as rib sides, loins, etc. These failed packages translate into spoiled food articles, meaning lost profits and wasted resources.

The typical prior art method of packaging such meat articles, which has led to such high losses, is to butcher, dress and otherwise process the meat and vacuum pack it in plastic. Containers, such as may be fabricated from corrugated paperboard material, are erected, and delivered to a location near the end of the processing line for the meat articles. The meat articles are then manually loaded into the containers, typically by dropping the articles from a height above the container. Dropping the articles causes the bone in the meat to pierce the bag, leading to loss of that particular food article.

It has additionally been observed that by spreading the packaging and handling process of such fragile articles out over a large area and span of time, introduces a greater likelihood of damage to the article, by increasing the opportunities for damage to occur.

It would be desirable, therefore, to develop a process for packaging of fragile articles, such as fragile food articles, without needing to drop the articles into previously erected container.

It would also be desirable to develop a process for packaging fragile articles, which would reduce the amount of physical manual handling of the article.

It is an object of the present invention, therefore, to provide a process and apparatus for the packaging of fragile articles, in which the amount of physical manual handling of the articles is reduced.

It is a further object of the present invention to provide a process and apparatus for the packaging of fragile articles, which reduces the size of the area and number of steps required in the process for packaging the fragile articles.

These and other objects of the invention will become apparent in light of the present specification, claims and drawings.

SUMMARY OF THE INVENTION

The present invention comprises, in part, a process for the facilitated packaging of fragile articles, including sharp and/or fragile food articles, without exposing the fragile articles to undesired physical shock that could otherwise break either the articles or intermediate containers surrounding the articles towards contamination thereof.

In particular, the process comprises the steps of transporting a plurality of the fragile articles, from a source of the fragile articles, to a loading position; transferring at least one of the fragile articles from the loading position, to a prestaging position, along at least one support surface, while maintaining the at least one fragile article in substantially continuous contact with the at least one support surface, and substantially without elevating the at least one fragile article above the at least one support surface; transferring an unarticulated container blank from a source of container blanks to a container forming position; transferring the at least one fragile article from the prestaging position to the loading position and onto the unarticulated container blank, substantially without elevating the article; forming a container around the at least one fragile article with the unarticulated container blank, while the article is maintained in contact with the bottom of the container and without disturbing the at least one article; closing the container formed around the at least one fragile article; and sealing the container formed around the at least one fragile article.

The step of transferring at least one of the fragile articles from the source to the loading position further comprises the steps of moving a movable article support surface from a first position adjacent to and substantially coplanar with the source of fragile articles; and sliding the at least one fragile article from the source onto the movable article support surface.

In a preferred embodiment of the invention, the step of transferring an unarticulated container blank from a source of container blanks to a container forming position, further comprises the steps of positioning a first portion of the unarticulated container blank to a position beneath a support surface; positioning a second portion of the unarticulated container blank to a position downstream of the support surface; and positioning a support member beneath the second portion of the unarticulated container blank to maintain the second portion of the unarticulated container blank in a position substantially coplanar with the support surface.

The step of transferring the at least one fragile article from the prestaging position to the loading position and onto the unarticulated container blank, substantially without elevating the article further comprises the step of repositioning the movable article support surface to a second position adjacent to and substantially coplanar with the upper surface of an article transport member; and propelling the at least one fragile article along the upper surface of the fragile transport member to the prestaging position.

The step of positioning the at least one fragile article onto an unarticulated container blank further comprises the step of propelling the at least one fragile article along the article transport member, over the support surface, and onto the second portion of the container blank, while maintaining the at least one fragile article in substantially continuous contact, successively, with the article transport member, the support surface, and the second portion of the container blank.

The present invention also comprises, in part, an apparatus for the facilitated packaging of fragile articles, including sharp and/or fragile food articles, without exposing the fragile articles to undesired physical shock that could otherwise break either the articles or intermediate containers surrounding the articles towards contamination thereof.

The apparatus comprises a source for delivering, in succession, a plurality of the fragile articles, to a loading position; means for receiving at least one of the fragile articles, from the source; means for transporting the at least one of the fragile articles from the receiving means to a prestaging position, while maintaining the at least one fragile article in substantially continuous contact with at least one support surface, the transporting means being operably associated with the means for receiving at least one of the fragile articles; a source of unarticulated container blanks; means for transferring unarticulated container blanks, in succession, from the source of container blanks to a container forming position; second means for transporting the at least one of the fragile articles from the prestaging position, to a position on a substantially flat, unarticulated container blank, which has been transferred to the container forming position, while maintaining the at least one fragile article in substantially continuous contact with the at least one support surface, to the container blank, the second transporting means being operably associated with the first transporting means; means for forming a container around the at least one fragile article with the unarticulated container blank; means for maintaining the formed container in its formed configuration while transferring the formed container away from the container forming position; means for closing the formed container around the at least one fragile article; and means for sealing the formed container around the at least one fragile article.

In a preferred embodiment of the invention, the source for delivering a plurality of fragile articles is a conveyor apparatus for transferring the fragile articles, from a location remote to the loading position, to the loading position. The means for receiving at least one of the fragile articles from the source comprises movable article support means, operably positionable between at least a first position, substantially adjacent to the source of fragile articles, and a second position, for enabling transfer of at least one fragile article from the source to means for transporting the at least one fragile article to the prestaging position.

The movable article means for transporting the at least one fragile article preferably comprises a support surface operably disposed substantially adjacent and coplanar to the movable article support surface, when the movable article support surface is in its second position; and a first pusher member being operably configured and juxtaposed relative to the movable article support means, so as to substantially surround the at least one fragile article, when the movable article support means is in its second position, the first pusher member being further operably configured for selective horizontal movement, for propelling the at least one fragile article along the support surface from the loading position to the prestaging position.

The second means for transporting the at least one fragile article preferably comprises a second pusher member, operably associated with the first pusher member for simultaneous horizontal movement therewith, the second pusher member being further operably configured for vertical movement relative to the first pusher member, from a first position substantially adjacent the support surface to a second position substantially above the support surface.

The means for forming a container further comprise vertically movable means for supporting an unarticulated container blank at the container forming position. The vertically movable means are operably configured for vertical movement between a first position, substantially coplanar with the support surface, and a second position, substantially below the support surface. A plurality of sequential forming members, are operably disposed in the container forming position, for forming the unarticulated container blank into a substantially formed container, as the vertically movable means moves from the first position to the second position.

In a preferred embodiment of the invention, a second support surface is operably disposed at a position substantially coplanar with the second position of the vertically movable means. The means for maintaining the formed container in its formed configuration while transferring the formed container away from the container forming position comprise at least one horizontally movable support member, operably associated with the second support surface for horizontal movement therealong, the at least one horizontally movable support member being movable from a first position substantially beneath and upstream of the container forming position, to a second position substantially beneath and downstream of the container forming position, for engaging and supporting an upstream side of the formed container; and at least one vertically movable support member, operably associated with the at least one horizontally movable support member, for simultaneous horizontal movement therewith.

The at least one vertically movable support member being operably configured for vertical movement relative to the second support surface between a first position, substantially above the second support surface for engaging and supporting a downstream side of a formed container, and a second position substantially below the support surface, for enabling the at least one vertically movable support member to propel a formed container along the second surface to a location downstream from the container forming position, while maintaining the container in its formed configuration and thereafter leaving the formed container in said location, while the at least one horizontally movable support member returns from its second position to its first position.

In a preferred embodiment of the invention, the source of unarticulated container blanks supplies the blanks to the apparatus in substantially flat configuration.

BRIEF DESCRIPTION OF THE DRAWINGS

FIG. 4 is a highly schematic exploded perspective illustration of the packaging apparatus according to FIG. 1;

FIG. 5 is a top plan view of a container blank, for use in the process of the present invention;

DETAILED DESCRIPTION OF THE INVENTION

Figure 1:
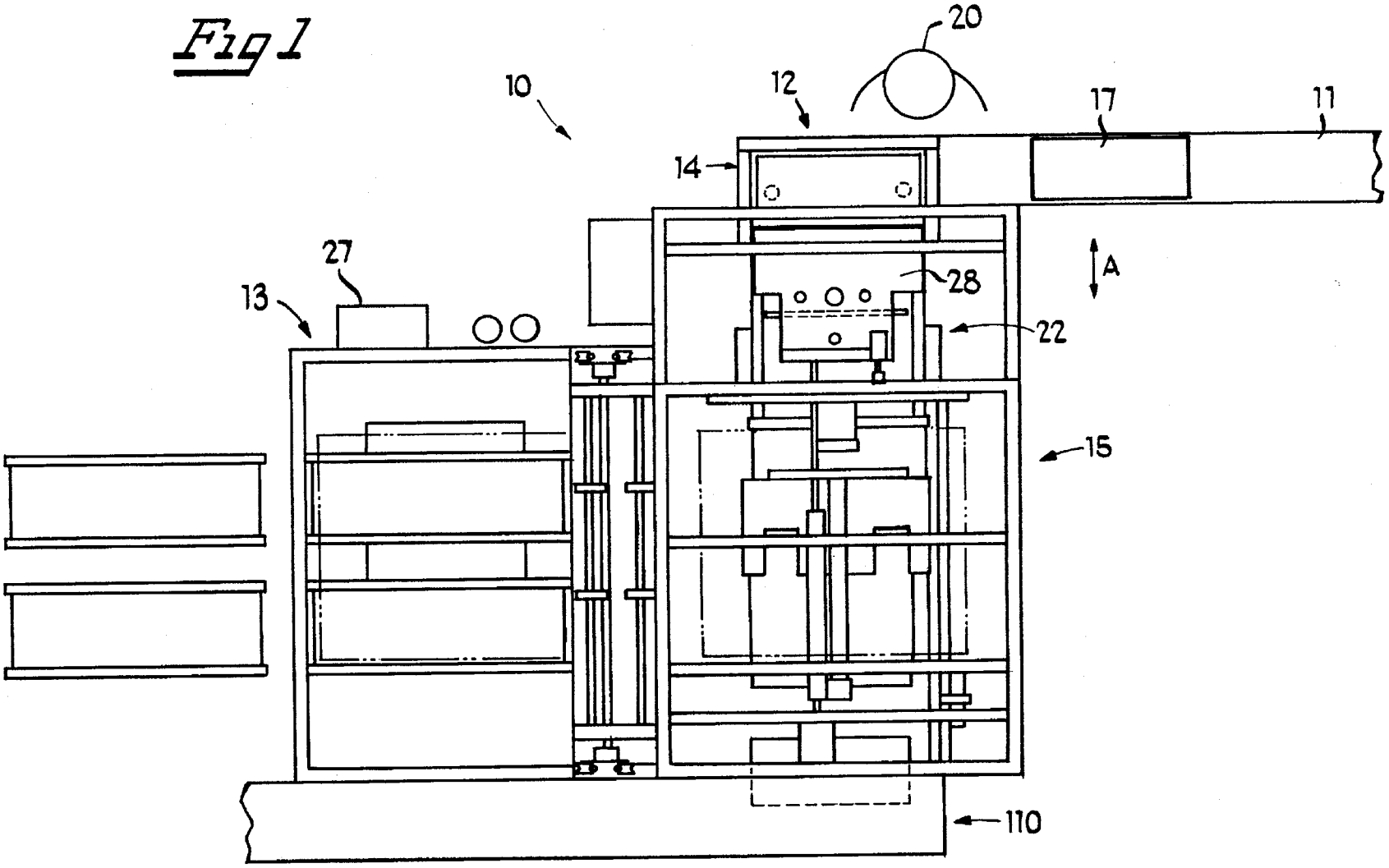
FIG. 1 is a top plan view of a packaging apparatus according to a preferred embodiment of the present invention.
Figure 2:
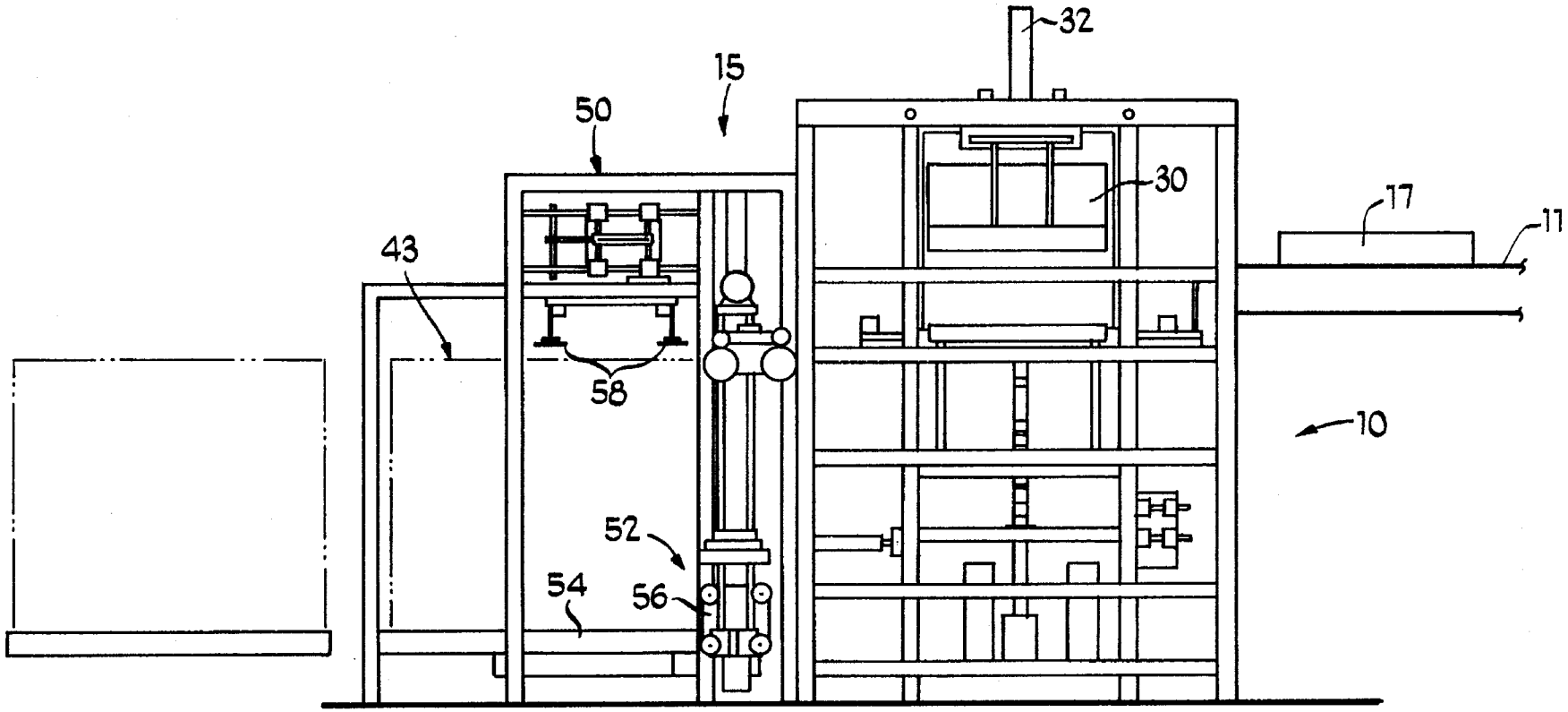
FIG. 2 is a rear end elevation of the packaging apparatus according to FIG. 1.
Figure 3:
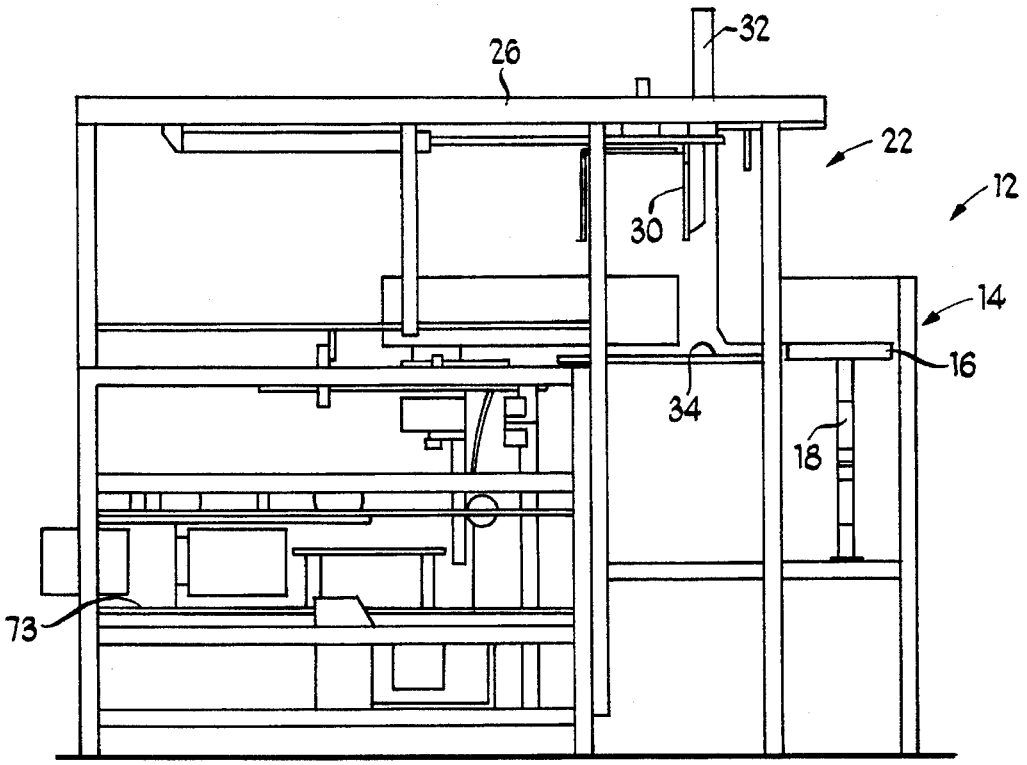
FIG. 3 is a left side elevation of the packaging apparatus according to FIG. 1.
Figure 9:
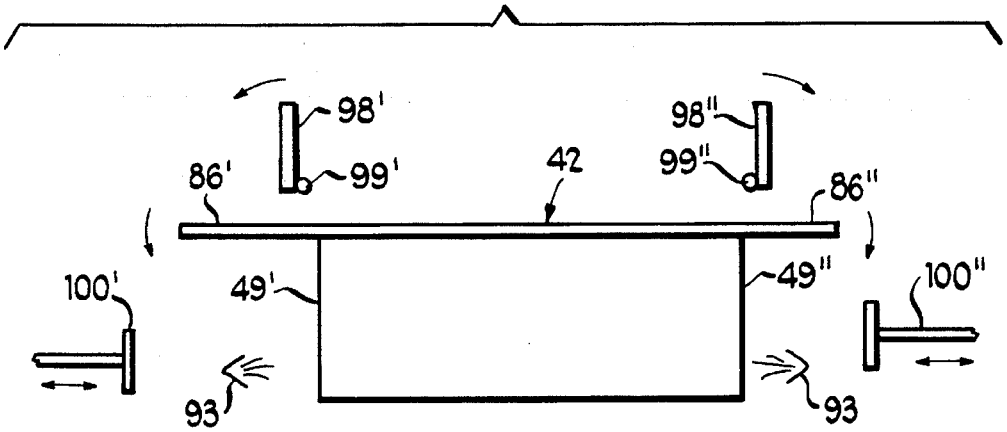
FIG. 9 is an end view schematic illustration of the compression section of the apparatus, situated downstream of the forming section, as seen when viewed from a position upstream of the compression section.
Figure 6:
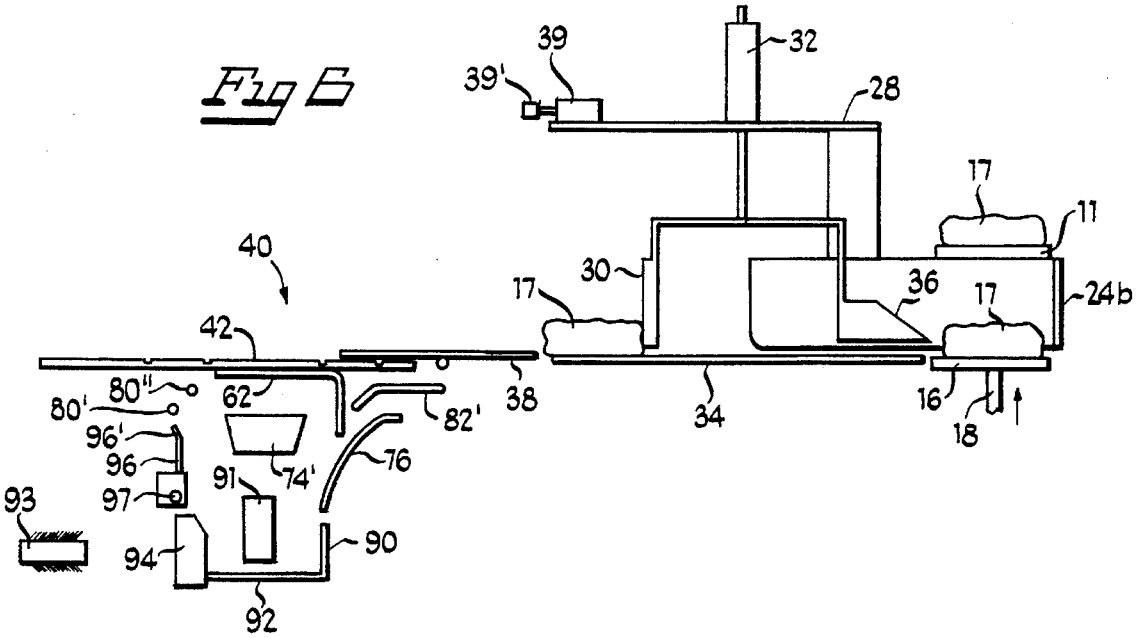
FIG. 6 is a side elevation of a schematic view of the apparatus according to FIG. 1, with the pusher apparatus in its initial position.
Figure 7:
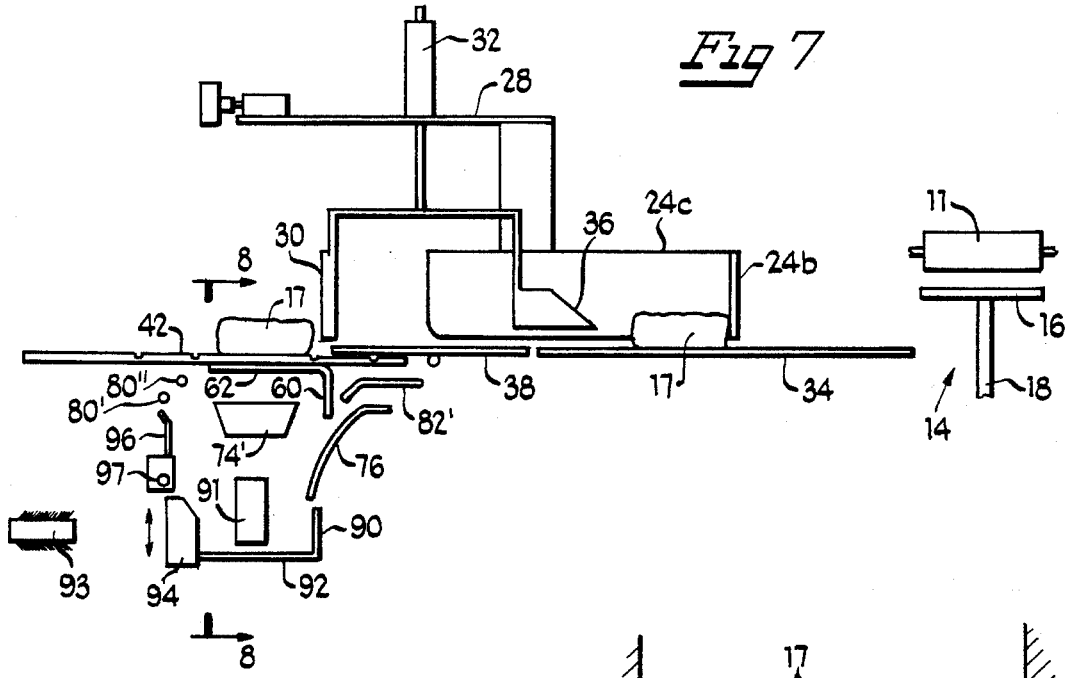
FIG. 7 is a side elevation of a schematic view of the apparatus according to FIG. 1, with the pusher apparatus in its downstream position.
Figure 8:
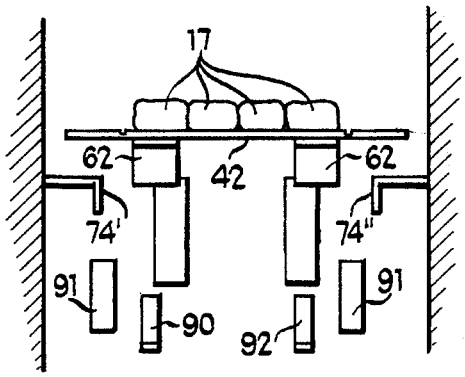
FIG. 8 is a rear elevation of the schematic view of FIG. 7, taken along the direction of the arrows 8—8, illustrated in FIG. 7.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Referring now to FIGS. 1–9, packaging apparatus 10 includes loading station 12, adjacent elevator 14. Elevator 14 is preferably includes a flat member 16 which is raisable and lowerable by, for example, a pneumatic or hydraulic piston and cylinder combination 18. Elevator 14 may be controlled by operator 20, by a switch or switches (not shown) suitably located in loading station 12. Apparatus 10 also includes container blank feeder 13, and container forming section 15.

The various components of apparatus 10 preferably are supported by a common frame 26, which may be of tubular steel. In order to protect both the mechanisms and the articles 17 from contamination, the entire apparatus 10 may be enclosed in a protective shell (not shown), such as Plexiglas sheeting, attached to frame 26, so as to enable visibility, will keeping out stray dust and other possible contaminants. The protective shell preferably will have doors or apertures provided, as necessary, for access to components needing to be maintained or adjusted frequently, and to enable entry of the product, the container blanks, and the finished packaged containers.

A control apparatus 27, preferably in the form of a suitably preprogrammed microprocessor or the like, will be provided, and suitably connected to the various valves, actuators, and manual controls, etc. of apparatus 10, for coordinating the various components using known programming techniques. Alternatively, a more simplified control system, relying upon the use of relays, limit switches and the like, may be employed.

Apparatus 10 preferably will be situated in a meat processing plant, for example, at the end of a suitably configured conveyor belt, roller conveyor or roller table 11, onto which just-processed and bagged meat articles 17 are placed. The meat articles 17 are conveyed onto conveyor 11 to loading station 12, in such a manner that a certain number of articles 17 will accumulate, but the operator will generally control the flow of articles 17 on conveyer 11, based upon the rate at which the operator can feed articles 17 into apparatus 10.

Pusher apparatus 22, in the form of a double-bucket or double-pusher configuration, includes a generally U-shaped pusher member 24, which includes longitudinal portions **24*a* and 24*c*, and transverse member 24*b*. Pusher member 24 preferably is operably suspended from frame 26, for reciprocating horizontal movement parallel to the direction of double-headed arrow A (see FIG. 1 ), for example by attachment to a carriage 28 along guide rails 28', 28", which are part of or are attached to frame 26**. For the purposes of the present disclosure, the direction which is downward, as FIG. 1 is viewed, is designated the downstream direction.

Pusher apparatus 22 also includes vertically adjustable pusher member 30, which may be mounted to carriage 28, for horizonal reciprocating movement with pusher member 24. Pusher member 30 may be affixed to the lower end of piston and cylinder combination 32, which may be hydraulically or pneumatically actuated, as previously described. Pusher member 24 is suspended slightly above the upper surface of transport member 34, which preferably may be a roller table having small diameter rollers or, alternatively, which may be a simple smooth surface suitable for sliding the fragile articles 17 without damaging them.

The range of movement of pusher member 24 is such that when pusher member 24 is in its upstream position, transverse portion **24*b* is slightly upstream of the upstream edge of member 16 of elevator 14. When pusher member 24 is in its downstream position, transverse portion 24*b* is slightly downstream of the position which pusher member 30 occupies, when pusher member 24 is in its upstream position. This location may be referred to as a staging position, and is at a downstream portion of transport member 34**.

A spring biased pneumatic shock absorber 39, with piston 39' is mounted on carriage 28, and positioned so as to abut a cross-member of frame 26, to help slow and cushion the movements of carriage 28 at the end of the pushing stroke. End-of-stroke sensors (not shown) may be provided on the cylinder which may be used to propel carriage 28. Such sensors would be suitably connected to controller 27 to indicate that the pusher member 24 has reached its forwardmost position, and to cause controller 27 to raise pusher member 30 and start the return movement of carriage 28.

Immediately downstream of transport member 34 is a further pivoting transport member 38. As schematically illustrated in FIG. 4, pivoting transport member 38 is configured to pivot between two positions, a flat position, in which the upper surface of member 38 is horizontal and flush with member 34, and a second position, in which member 38 is rotated (clockwise as seen in FIG. 4). The downstream edge of member 38 substantially defines the end of loading station 12, and the beginning of container forming section 15 of apparatus 10.

A guide member 36 may be attached to pusher member 30, for simultaneous vertical movement with pusher member 30, and positioned relative to transverse portion **24*b* of pusher member 24, such that when pusher member 24 is in its upstream position, the guide member is slightly downstream of the downstream edge of member 16 of elevator 14, so that a loading pocket is defined by the guide member, transverse member 24*a*, longitudinal portions 24*a* and 24*c*, and member 16 of elevator 14 (when member 16 of elevator 14** is in a lowered position).

Container load position 40, of forming section 15, is situated immediately downstream of the downstream edge of member 38. In a manner to be more fully described hereinafter, unfolded container blanks from container blank feeder 13 (such as blank 42 of FIG. 5) will be positioned in load position 40, such that the bottom panel 44 of a blank 42 will be positioned immediately downstream of the downstream edge of member 38, and slightly below the surface of member 38. Front panel 46 will be below member 38, when blank 42 is in load position 40.

The operation of pusher apparatus 22 is as follows. Pusher member 24 is initially in its upstream position. Vertically movable pusher member 30, and guide 38 will be in their lowered positions. Member 16 of elevator 14 preferably will be in its uppermost position. Operator 20 will transfer, preferably by sliding (to avoid having to lift the fragile product as much as possible) a predetermined number of articles 17 from conveyor 11, enough to substantially occupy the space enclosed by the loading pocket, by aligning the articles 17 gently over member 16, and actuating the elevator 14, to cause member 16 to descend. If any of the articles 17 requires some slight adjustment of its physical placement, prior to the next loading step, the operator 20 does so. At no time are the articles 17 forced into the loading pocket.

The shape and configuration of some food articles 17 may enable the articles 17 to be stacked within the container. To accomplish such stacking, the (ultimately) lower of the two articles 17 is slid onto member 16 of elevator 14, and the elevator is lowered a predetermined amount. The amount of lowering will not be so much as to place member 16 level with transport member 34. The (ultimately) upper of the two articles 17 is then slid onto the first, lower article, and then member 16 is lowered to be flush with elevator 14. The loading process otherwise continues as previously described.

When the loading pocket has been filled, operator 20 will actuate elevator 14, so as to place member 16 flush with member 34. Operator 20 will then actuate pusher apparatus 22. With pusher member 30 and guide member 38 in their lowered positions, pusher member 24 will be actuated to move downstream, moving the articles 17 to an intermediate staging position. Once pusher member 24 is in its downstream position, pusher member 30 and guide member 38 will be raised and held in their raised positions, and pusher member 24 is automatically returned to its upstream position. Pusher member 30 and guide member 38 will then be lowered, with pusher member 30 now being situated just upstream of the articles 17 which have been pushed toward into the prestaging position, immediately upstream of loading position 40.

Operator 20 will now proceed to re-fill the loading pocket. Upon further actuation of pusher apparatus 22, the articles 17 in the intermediate staging position will be pushed by pusher member 30 off of member 34, over and past member 38, and onto bottom panel 44 of a blank 42 which has, in the interim, been positioned in loading position 42.

Container blank feeder 15 may be a high capacity top-of-the-stack feeder, having a configuration generally similar to that of known feeders manufactured by such entities as Southern Packaging and Bemis. Feeder 15 preferably includes container blank hopper 50. Blank elevator 52 includes blank support member 54, which is vertically raisable and lowerable by any suitable means, such as a chain drive, or a hydraulic or pneumatic piston and cylinder combination. A desired quantity of container blanks, such as container blank 42, are loaded in any suitable manner (including manually) onto support member 54. Appropriate sensors (not shown) may be connected to the mechanism for raising member 54, such that the relative elevation of member 54 will be monitored, and communicated to the control apparatus, for providing an indication that the stack of blanks is getting low.

In the upper portion of feeder 13 is blank lifting apparatus 56, which includes one or more raisable and lowerable suction cups 58, which may be raised or lowered in any suitable manner, such as hydraulically or pneumatically. The elevation of member 54 will be suitably controlled, such that the topmost blank 42 in a stack of blanks 43 will always be maintained slightly below the level of suction cup(s) 58, when suction cup(s) 58 are in their raised positions.

When the packaging procedure calls for a fresh container blank to be positioned into loading position 40, suction cup(s) 58 are lowered until contact is made with the upper surface of the uppermost blank 42 of stack 43. The suction cup(s) are actuated, and grasp the topmost blank. Suction cup(s) 58 are raised. The topmost blank 42 is thus raised, and positioned such that a suitable transport apparatus, which may be of otherwise conventional configuration (and the specific details of which have been omitted from the drawing for clarity of illustration), may propel the blank 42 into loading position 40.

A roller table 73 is positioned in the lower portion of forming section 15. As a fresh blank 42 is propelled into loading position 40, elevator 60, including container support member 62, is raised (e.g., pneumatically, etc.), such that support member 62 supports and is positioned directly beneath bottom panel 44 of container blank 42. Blank 42 is propelled and guided by suitable guide members into loading position 40 such that front panel 46 of blank 42 is positioned beneath member 38.

Container forming section 15 includes a plurality of sequential folding ploughs including end panel ploughs 74', 74", front panel ploughs 76 (which are to the sides of elevator 60), minor flap ploughs 78" and 80", lid ploughs 78' and 80', and minor flap ploughs 82' and 82". The folding ploughs are all fixed, relative to frame 26 of apparatus 10. Ploughs 74', 74" preferably are not completely vertical, but instead are each at a slight angle from the vertical, so that their top edges are farther apart than their lower portions. In addition, ploughs 74', 74" need not be flat sheet members, but may have a bend or curve to them, such that their lower surfaces are closer to vertical than their upper surfaces. In addition, ploughs 74', 74" and 76 may be substantially single-sheet panel members, or they may be constructed of several plough members, arranged in parallel, and suitably spaced from one another, for example, to accommodate other apparatus components therebetween.

After pusher apparatus 22 pushes the articles 17 onto bottom panel 44 of blank 42, in the manner previously described, container elevator is lowered. As support member 62 descends, various portions of container blank 42 encounter the various folding ploughs to cause the respective portions of the blank to fold upward.

In a preferred embodiment, blank 42 is so configured that until force of a certain minimum amount is directly applied to cause folding of one portion relative to another portion, the various portions of the blank will remain in a substantially flat or unfolded relationship. Specifically, minor flaps 47', 47", 47''', and 47'''' strike ploughs 80", 82', 78", 82", respectively. Minor flaps 47', 47", 47''', and 47'''' fold upwardly, along respective fold lines 48', 48", 48''', and 48''''. End panels 49', 49" then strike end panel ploughs 74', 74" and are raised substantially perpendicular to bottom panel 44.

At substantially the same time, front panel 46 encounters front panel plough 76 and rear panel 45 encounters the upper, inclined ends 96' of lid closing members 96. Plough 76 forces front panel 46 to bend upward, relative to bottom panel 44, along fold line 44'. Inclined ends 96' force rear panel 45 to bend upward, relative to bottom panel 44, along fold line 44". As elevator 60 descends and rear panel 45 rises, major flaps 86', 86" pass between ploughs 78', 78" and 80', 80", respectively to help guide and support flaps 86', 86".

During this procedure, pivoting transport member 38 is caused to rotate clockwise, as seen in the figures, to provide clearance for front panel 46 as it is folded upward during the descent of elevator 60. Bottom panel rests upon transport support members 92, which may be in the form to two parallel, spaced beam members, generally arranged so as to be flush with the upper surface of roller table 73. Front panel 46 is brought up against and held vertical by vertical support(s) 90 (which may be affixed to transport support members 92.

Rear panel 45 is brought up against and held vertical by rear support member(s) 94. Preferably, rear support members 94 comprise two vertically movable spaced members, which are also configured to move horizontally, in lockstep with support members 90, 92. Rear support members 94 moved by, for example, raisable and lowerable pistons, such that when lowered, so as to be flush with or slightly below the top surface of roller table 73. In this way, after support members 90, 92 and 94 have indexed a container out of the loading position 40, support members 90, 92 and 94 can be returned to their initial position in loading position 40, lowered support members 94 passing beneath the just-indexed container. When the next forming container is propelled by support members 90, the downstream faces of support members 94 may be configured to abut and propel the immediately preceding container, which (as described hereinafter) has now been fully closed and sealed, onward through an opening in apparatus 10, into a queue for a waiting conveyor.

Front panel lip 46' is now, in the preferred embodiment, folded over to a horizontal position, substantially parallel to bottom panel 44, by one or more lip folding member(s) 95, which preferably are mounted on a pivoting shaft (or are otherwise pivotably mounted) so as to be behind or beneath plough 76, when members 95 are in their raised positions. When actuated, members rotate outwardly and downwardly from behind plough 76, to fold lip 46' inwardly. Lip folding members 95 may be gear driven or moved by piston and cylinder combinations. End panel support members 91 may be provided at either side of support 92, for holding end panels 49', 49" vertical, when the forming container has descended past.

An adhesive applying apparatus (not shown) may be provided to apply adhesive to the now upper surface of folded-over lip 46'. Lid closing members 96 are suspended and supported by frame 26, and suitably pivotably mounted for powered rotation clockwise, from their raised position (drawn in solid lines) to their lowered position (in phantom). When raised, inclined ends 96' push against descending rear panel 45, and bend it upwards. As the descent continues, rear panel 45 is further urged to bend upward, gradually, by inclined surfaces 94' of rear panel support members 94. Movement of lid closing members 96 may be accomplished, for example, by mounting members 96 fixedly upon a rotatable shaft 97, rotatably mounted relative to frame 26, and powered in any suitable known manner, such as by gearing, or by appropriately positioned piston and cylinder combinations. Movement of lid closing members 96 to the horizontal, results in the folding of lid 87 about fold line 88 over the top of the forming container, and onto and over lip 46'.

At this point in the process, the substantially erected container is propelled by support members 90 transported by transport apparatus 70, which may be suitably mounted on guide rails (not shown) and propelled (by gears, piston and cylinder combination, etc.) to a position downstream of loading position 40. Once the substantially formed container has been moved to predetermined downstream position, supports 94, which are mounted for vertical movement, relative to roller table 73, descend to allow the erected container to remain in place, and permit supports 90, 92 and 94 to be returned to their upstream position.

As the container is moved downstream into a compression section from forming section 15, adhesive (such as hot melt glue) applicators 93 (which may be of known configuration), positioned immediately downstream of end panel support members 91, apply adhesive to the outside surfaces of end panels 49', 49". Major flaps 86', 86" are then folded downward parallel to and against end panels 49', 49" (now each bearing adhesive), by major flap folding members 98', 98", which may be affixed to powered rotatable shafts 99', 99", which may be rotatably mounted relative to frame 26, and powered, in the manner described with respect to lid closing members 96. Compressor members 100', 100", which preferably are piston and cylinder driven, are mounted on frame 26, so as to press the folded-down major flaps 86', 86", while the applied adhesive is cooling, to assure closure of the packed container.

It is to be understood that the design of the specific configuration of the container forming components may be readily altered, by one having ordinary skill in the art, from that configuration disclosed, in order to accommodate container blanks for containers having different relative proportions or configurations.

The loaded container is now fully assembled, closed and ready for transport from apparatus 10. The container is then further propelled downstream, out of apparatus 10, and onto a suitable conveyor or roller table 110, for further handling, the fragile food product contents now being protected by the container, with a minimum of manual handling and physical shock.

It may be seen that the apparatus and process of the present invention may be employed not only in the packaging of meat, but also in the packaging of other fragile or difficult to handle food articles, such as eggs, or even the packaging of other fragile or difficult to handle non-food articles.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

We claim:

1. A process for the facilitated packaging of fragile articles, including sharp and/or fragile food articles, without exposing the fragile articles to undesired physical shock and stress that could otherwise break either the articles or intermediate containers surrounding the articles towards contamination thereof, the process comprising the steps of:

transporting a plurality of the fragile articles, from a source of the fragile articles, to a loading position;

transferring at least one of the fragile articles from the loading position, to a prestaging position, along at least a first of two or more support surfaces, while maintaining the at least one fragile article in substantially continous contact with the first support surface, and without exerting substantial compressive forces on the at least one fragile article which would tend to damage the at least one fragile article, and substantially without elevating the at least one fragile article above the first support surface, including the steps of positioning the at least one of the fragile articles onto a portion of the first support surface which is configured to be vertically movable relative to at least a remaining portion of the first support surface, vertically moving the portion of the first support surface, and thereafter completing the transfer of the at least one article to the prestaging position;

transferring a substantially flat unarticulated container blank from a source of container blanks to a container forming position, in part, by positioning a first portion of the substantially flat container blank to a position onto a second vertically movable support surface, the second vertically movable support surface being positionable from a first position substantially level with at least a portion of the remaining portion of the first support surface, to a second position below the remaining portion of the first support surface and substantially level with a second support surface;

transferring the at least one fragile article from the prestaging position to the loading position and onto the substantially flat unarticulated container blank at the container forming position, without substantially elevating the article, and without exerting substantial compressive forces on the, at least one fragile article which would tend to damage the at least one fragile article, the second vertically movable support surface being positioned at the first position while the at least one fragile article is transferred onto the substantially flat container blank;

forming a container around the at least one fragile article with the unarticulated container blank, while the article is maintained in contact with the bottom of the container and without disturbing the at least one article, by moving the second vertically movable support surface to the second position and causing one or more portions of the container blank to come into contact with and pass one or more substantially fixed sequential forming members, so as to cause the one or more portions of the container blank to be moved into articulated positions forming a substantially articulated container about said fragile article, the weight of the at least one fragile article assisting in the articulation of the one or more portions, by restraining the container blank in place on the second vertically movable support surface during the movement of the second vertically movable support surface from the first position to the second position, the forming of the container occurring substantially without the exertion of force upon the at least one fragile article, from outside the container; and completing closing of the container formed around the at least one fragile article.

2. The process according to claim 1, wherein the step of transferring at least one of the fragile articles from the source to the loading position, further comprises the steps of:

moving a movable article support surface from a first position adjacent to and substantially coplanar with the source of fragile articles;

sliding the at least one fragile article from the source onto the movable article support surface.

3. The process according to claim 1, wherein the step of transferring the at least one fragile article from the prestaging position to the loading position and onto the unarticulated container blank, substantially without elevating the article further comprises the step of:

repositioning the movable article support surface to a second position adjacent to and substantially coplanar with the upper surface of an article transport member; and propelling the at least one fragile article along the upper surface of the article transport member to the prestaging position.

4. The process according to claim 3, wherein the step of positioning the at least one fragile article onto an unarticulated container blank further comprises the step of:

propelling the at least one fragile article along the article transport member, over the support surface, and onto the second portion of the container blank, while maintaining the at least one fragile article in substantially continuous contact, successively, with the article transport member, the support surface, and the second portion of the container blank.

5. An apparatus for the facilitated packaging of fragile articles, including sharp and/or fragile food articles, without exposing the fragile articles to undesired physical shock and stress that could otherwise break either the articles or intermediate containers surrounding the articles towards contamination thereof, the apparatus comprising:

a source for delivering, in succession, a plurality of the fragile articles, to a loading position;

means for receiving at least one of the fragile articles, from the source, the receiving means including a first support surface, having a portion being configured to be vertically movable relative to at least a remaining portion of the first support surface, for facilitating receipt of the at least one of the fragile articles from the source for delivering fragile articles;

means for transporting the at least one of the fragile articles from the receiving means to a prestaging position, and without exerting substantial compressive forces on the at least one fragile article which would tend to damage the at least one fragile article, while maintaining the at least one fragile article in substantially continuous contact with the first support surface, the transporting means being operably associated with the means for receiving at least one of the fragile articles;

a source of unarticulated container blanks;

means for transferring unarticulated container blanks, in succession, from the source of container blanks to a container forming position;

second means for transferring the at least one of the fragile articles from the prestaging position, to a position on a substantially flat, unarticulated container blank, which has been transferred to the container forming position, while maintaining the at least one fragile article in substantially continuous contact with the first support surface, and without exerting substantial compressive forces on the at least one fragile article which would tend to damage the at least one fragile article, to the container blank, the second transporting means being operably associated with the first transporting means;

means for forming a container around the at least one fragile article with the unarticulated container blank, including second vertically movable support means for supporting from beneath, an unarticulated container blank which has been transferred to at the container forming position, the second vertically movable means being operably configured for vertical movement between a first position, substantially coplanar with at least a portion of the remaining portion of the first support surface, and a second position, substantially below the remaining portion of the first support surface and substantially level with a second support surface, one or more sequential forming members, operably positioned about the container forming position, in substantially fixed positions relative thereto, for forming the unarticulated container blank into a substantially formed container, as the vertically movable means moves from the first position to the second position, the container blank being substantially restrained on the second vertically movable means at least in part by the at least one fragile article, as the second vertically movable means moves from the first position to the second position, the means for forming of the container being operably configured so as to form the container substantially without the exertion of force upon the at least one fragile article, from outside the container;

means for maintaining the formed container in its formed configuration while transferring the formed container away from the container forming position; and means for completing closing the formed container around the at least one fragile article.

6. The apparatus according to claim 5, wherein the source for delivering a plurality of fragile articles is a conveyor apparatus for transferring the fragile articles, from a location remote to the loading position to the loading position, and the means for receiving at least one of the fragile articles from the source comprises movable article support means, operably positionable between at least a first position, substantially adjacent to the source of fragile articles, and a second position, for enabling transfer of at least one fragile article from the source to means for transporting the at least one fragile article to the prestaging position.

7. The apparatus according to claim 6, wherein the movable article support means for transporting the at least one fragile article comprises:

a support surface operably disposed substantially adjacent and coplanar to the movable article support surface, when the movable article support surface is in its second position; and a first pusher member being operably configured and juxtaposed relative to the movable article support means, so as to substantially surround the at least one fragile article, when the movable article support means is in its second position, the first pusher member being further operably configured for selective horizontal movement, for propelling the at least one fragile article along the support surface from the loading position to the prestaging position.

8. The apparatus according to claim 7, wherein the second means for transporting the at least one fragile article comprises:

a second pusher member, operably associated with the first pusher member for simultaneous horizontal movement therewith, the second pusher member being further operably configured for vertical movement relative to the first pusher member, from a first position substantially adjacent the support surface to a second position substantially above the support surface.

9. The apparatus according to claim 8, wherein a second support surface is operably disposed at a position substantially coplanar with the second position of the vertically movable means, and the means for maintaining the formed container in its formed configuration while transferring the formed container away from the container forming position comprise:

at least one horizontally movable support member, operably associated with the second support surface for horizontal movement therealong, the at least one horizontally movable support member being movable from a first position substantially beneath and upstream of the container forming position, to a second position substantially beneath and downstream of the container forming position, for engaging and supporting an upstream side of the formed container; and at least one vertically movable support member, operably associated with the at least one horizontally movable support member, for simultaneous horizontal movement therewith, the at least one vertically movable support member being operably configured for vertical movement relative to the second support surface between a first position, substantially above the second support surface for engaging and supporting a downstream side of a formed container, and a second position substantially below the support surface, for enabling the at least one vertically movable support member to propel a formed container along the second surface to a location downstream from the container forming position, while maintaining the container in its formed configuration and thereafter leaving the formed container in said location, while the at least one horizontally movable support member returns from its second position to its first position.

10. The apparatus according to claim 5, wherein the source of unarticulated container blanks supplies the blanks to the apparatus in substantially flat configuration.

* * * * *